US006835116B2

(12) United States Patent
Oguri et al.

(10) Patent No.: US 6,835,116 B2
(45) Date of Patent: Dec. 28, 2004

(54) POLISHING APPARATUS

(75) Inventors: Shozo Oguri, Yokohama (JP); Hideo Aizawa, Ayase (JP); Kenichi Shigeta, Yokohama (JP); Yoshikuni Tateyama, Hiratsuka (JP)

(73) Assignee: Ebara Corporation, Tokyo (JP)

( * ) Notice: Subject to any disclaimer, the term of this patent is extended or adjusted under 35 U.S.C. 154(b) by 344 days.

(21) Appl. No.: 09/764,318

(22) Filed: Jan. 19, 2001

(65) Prior Publication Data

US 2001/0012749 A1 Aug. 9, 2001

(30) Foreign Application Priority Data

Jan. 21, 2000 (JP) ..... 2000-012856

(51) Int. Cl.[7] ..... B24B 49/00
(52) U.S. Cl. ..... 451/8; 451/56; 451/72
(58) Field of Search ..... 451/8, 56, 72, 451/443, 6; 700/175, 179, 164

(56) References Cited

U.S. PATENT DOCUMENTS 5,618,447 A * 4/1997 Sandhu ..... 438/14
5,834,645 A * 11/1998 Bartels et al. ..... 73/105
5,875,559 A 3/1999 Birang et al.
5,974,679 A * 11/1999 Birang et al. ..... 33/553
5,975,994 A * 11/1999 Sandhu et al. ..... 451/56
6,040,244 A * 3/2000 Arai et al. ..... 438/691
6,123,607 A * 9/2000 Ravkin et al.
6,126,511 A * 10/2000 Hayakawa et al.
6,238,273 B1 * 5/2001 Southwick ..... 451/41
6,306,008 B1 * 10/2001 Moore ..... 451/5

* cited by examiner

*Primary Examiner*—David B. Thomas
(74) *Attorney, Agent, or Firm*—Wenderoth, Lind & Ponack, L.L.P.

(57) ABSTRACT

A polishing apparatus for polishing a workpiece comprises a polishing table having a polishing surface and a top ring for holding the workpiece and pressing the workpiece against the polishing surface. The polishing table and the top ring are rotated independently of each other. The polishing apparatus further comprises a dresser for dressing the polishing surface with certain timing and a sensor for observing a property of the polishing surface on the polishing table when the polishing surface is being dressed by the dresser.

12 Claims, 4 Drawing Sheets

POLISHING APPARATUS

BACKGROUND OF THE INVENTION

1. Field of the Invention

The present invention relates to a polishing apparatus, and more particularly to a polishing apparatus for polishing a substrate such as a semiconductor wafer to a flat mirror finish.

2. Description of the Related Art

Conventionally, a polishing apparatus for polishing a substrate such as a semiconductor wafer to a flat mirror finish comprises a turntable having a polishing pad or a grinding stone (fixed abrasive) thereon, and a top ring for holding the substrate. The substrate to be polished is placed between the polishing pad or the grinding stone on the turntable and the top ring. While the substrate is pressed against the polishing pad or the grinding stone under a certain pressure by the top ring, the turntable and the top ring are respectively rotated to cause a relative motion therebetween for thereby polishing the substrate.

In the polishing apparatus with the polishing pad on the turntable, a polishing liquid is supplied to a polishing area of the polishing pad. On the other hand, in the polishing apparatus with the grinding stone (fixed abrasive) on the turntable, water is supplied to a polishing area of the grinding stone. A grinding stone impregnated with a lubricating liquid can dispense with the liquid supply from an external source. The substrate is polished to a flat mirror finish in a polishing process performed by the polishing apparatus thus constructed. After the substrate is polished, the substrate is released from the top ring and delivered to a next process such as a cleaning process.

While the substrate is polished by the polishing apparatus, the substrate held by the top ring is pressed against a polishing surface of the polishing pad or the grinding stone. As a result, polishing performance of the polishing pad or the grinding stone may be deteriorated due to glazing of the polishing surface, or the polishing surface of the polishing pad or the grinding stone may have undulation beyond an allowable degree. In such cases, the polishing pad or the grinding stone is dressed to recover a desired polishing surface.

In this type of conventional polishing apparatus, it has heretofore been necessary to manage the timing of dressing of the polishing pad or the grinding stone based on the number of polished substrates or the polishing time, e.g., the time when the polishing pad or the grinding stone has been used to polish substrates. Further, in order to recognize how the polishing surface has changed, it is necessary to remove the polishing pad from the turntable, and then remove a soft layer of the polishing pad and measure configurational changes, e.g., changes in thickness of a hard layer of the polishing pad.

SUMMARY OF THE INVENTION

The present invention has been made in view of the above drawbacks. It is therefore an object of the present invention to provide a polishing apparatus which can easily measure changes in condition of a polishing surface, can appropriately determine when to dress the polishing surface and to replace a component of the polishing surface, and can polish a surface of a substrate to a high-quality finish.

According to an aspect of the present invention, there is provided a polishing apparatus for polishing a workpiece, the polishing apparatus comprising: a polishing table having a polishing surface; a top ring for holding the workpiece and pressing the workpiece against the polishing surface; a dresser for dressing the polishing surface; and a sensor for observing a property of the polishing surface on the polishing table when the polishing surface is being dressed by the dresser. The polishing apparatus may further comprise a display device for displaying the property of the polishing surface observed by the sensor.

When the polishing surface is dressed by the dresser, a property of the polishing surface on the polishing table can be observed by the sensor. For example, the property of the polishing surface may be irregularity or undulation thereof. The observed property may be displayed by the display device. Therefore, the property of the polishing surface can easily be recognized.

The sensor may be mounted on a fixed member of the top ring or the dresser which is angularly movable. The sensor may comprise a displacement sensor.

In a preferred aspect of the present invention, the sensor is mounted on one of the top ring and the dresser and is vertically movable independently of the top ring or the dresser.

Since the sensor is mounted on the top ring or the dresser and is vertically movable independently of the top ring or the dresser, the position of the sensor can easily be adjusted with respect to the polishing surface. It is thus easy to adjust the sensor to a position optimum for measuring the property of the polishing surface.

At least a portion of the sensor which is brought into contact with a polishing liquid or a dressing liquid may be made of a material having chemical resistance. Hence, the sensor is not corroded by the polishing liquid or the dressing liquid, and durability of the sensor can be improved.

In a preferred aspect of the present invention, the sensor measures a property of the polishing surface over an area larger than an area which is dressed by the dresser.

Since the sensor measures a property of the polishing surface over an area larger than an area which is dressed by the dresser, the property of the polishing surface can reliably be measured.

In a preferred aspect of the present invention, the polishing apparatus further comprises a determination device for comparing an initial property of the polishing surface which is measured by the sensor with a property of the polishing surface which is measured by the sensor after the polishing surface is dressed by the dresser, and determining when to replace a component of the polishing surface based on the result of comparison.

Since the polishing apparatus comprises the determination device, the initial property of the polishing surface can be compared with the property of the polishing surface after the polishing surface is recovered by the dresser. Therefore, a component of the polishing surface can be replaced with a new one at an optimum time.

According to another aspect of the present invention, there is provided a method for polishing a workpiece, comprising: holding the workpiece and pressing the workpiece against a polishing surface on a polishing table to polish the workpiece; observing a property of the polishing surface on the polishing table by a sensor when the polishing surface is being dressed by a dresser; comparing an initial property of the polishing surface which is measured by the sensor with a property of the polishing surface which is measured by the sensor after the polishing surface is dressed by the dresser; and determining when to stop the dressing operation based on the result of comparison.

Since an initial property of the polishing surface is compared with a property of the polishing surface after the polishing surface is dressed by the dresser, it is easy to determine when to stop the dressing operation based on the result of comparison. Therefore, the dressing operation can be stopped at an optimum time.

The above and other objects, features, and advantages of the present invention will be apparent from the following description when taken in conjunction with the accompanying drawings which illustrates preferred embodiments of the present invention by way of example.

DETAILED DESCRIPTION OF THE PREFERRED EMBODIMENTS

Figure 1:
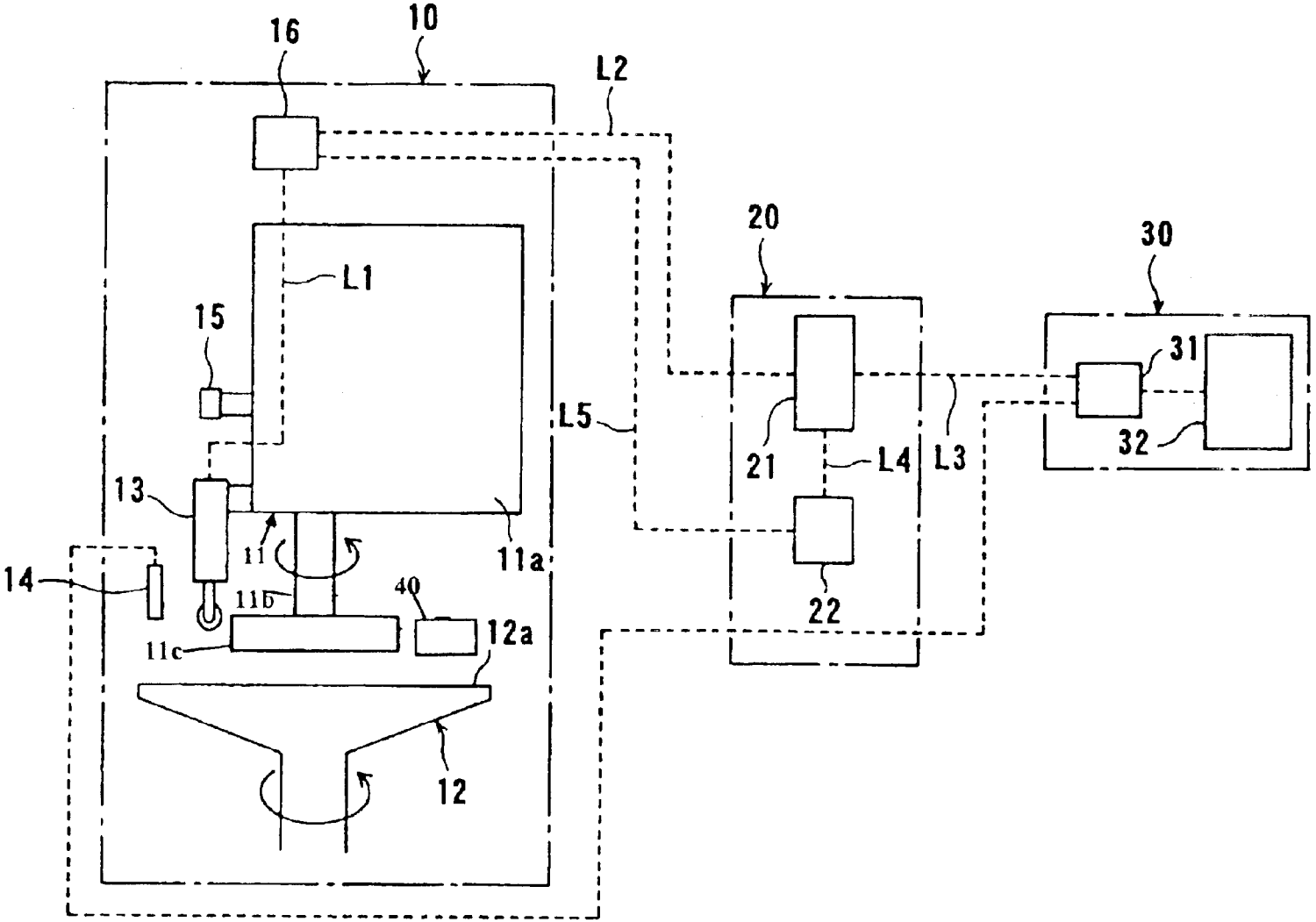
FIG. 1 is a schematic view showing a configuration of a polishing apparatus according to an embodiment of the present invention.

A polishing apparatus according to an embodiment of the present invention will be described below with reference to FIGS. 1 through 3. FIG. 1 is a schematic view showing a configuration of a polishing apparatus according to an embodiment of the present invention. As shown in FIG. 1, the polishing apparatus comprises a polishing assembly 10, a measuring box 20, and a recorder 30.

The polishing assembly 10 comprises a top ring 40 for holding a substrate (workpiece) to be polished such as a semiconductor wafer, a turntable 12 constituting a polishing table and having a polishing surface 12*a* thereon, and a dresser 11 for dressing the polishing surface. In the present embodiment, the polishing surface 12*a* is constituted by an upper surface of a polishing pad attached to the turntable 12. The substrate to be polished is placed between the top ring 40 and the polishing surface 12*a* on the turntable 12. While the substrate is pressed against the polishing surface 12*a* under a certain pressure by the top ring 40, the turntable 12 and the top ring are respectively rotated to polish the substrate. The polishing surface 12*a* is dressed by the dresser 11 at a suitable time to recover original polishing performance.

The measuring box 20 comprises a display device 21 and a power supply 22 therein. The recorder 30 comprises a data collection system 31 and a personal computer 32. The polishing assembly 10 further comprises a sensor 13 for measuring a property, e.g., thickness, of the polishing surface 12*a* on the turntable 12, a dresser sting switch 14, a photomicrosensor 15, and an amplifier 16.

The sensor 13 outputs a signal representing the measured property of the polishing surface 12*a* through a wire L1 to the amplifier 16, and the supplied signal is amplified by the amplifier 16. The wire L1 should preferably be as short as possible. The amplified signal is then transmitted to the display device 21 in the measuring box 20 through a wire L2 having good noise immunity. The display device 21 displays the property of the polishing surface 12*a*. The signal supplied to the display device 21 is further transmitted to the data collection system 31 in the recorder 30 through a wire L3 having good noise immunity. The power supply 22 in the measuring box 20 supplies power to the display device 21 in the measuring box 20 and the amplifier 16 in the polishing assembly 10 through respective wires L4 and L5 having good noise immunity.

The dresser 11 comprises a dresser head 11*a* which is vertically movable and horizontally swingable by a swing arm (not shown). A dressing tool 11*c* for recovering the polishing surface 12*a* is rotatably mounted on the dresser head 11*a* via a rotatable shaft 11*b*.

The sensor 13 is mounted on the dresser head 11*a* and vertically movable independently of the dresser head 11*a*. The position of the sensor 13 is controlled based on a signal from the photomicrosensor 15 so that the sensor 13 does not interfere with the dresser head 11*a* and the polishing surface 12*a*.

Figure 2:
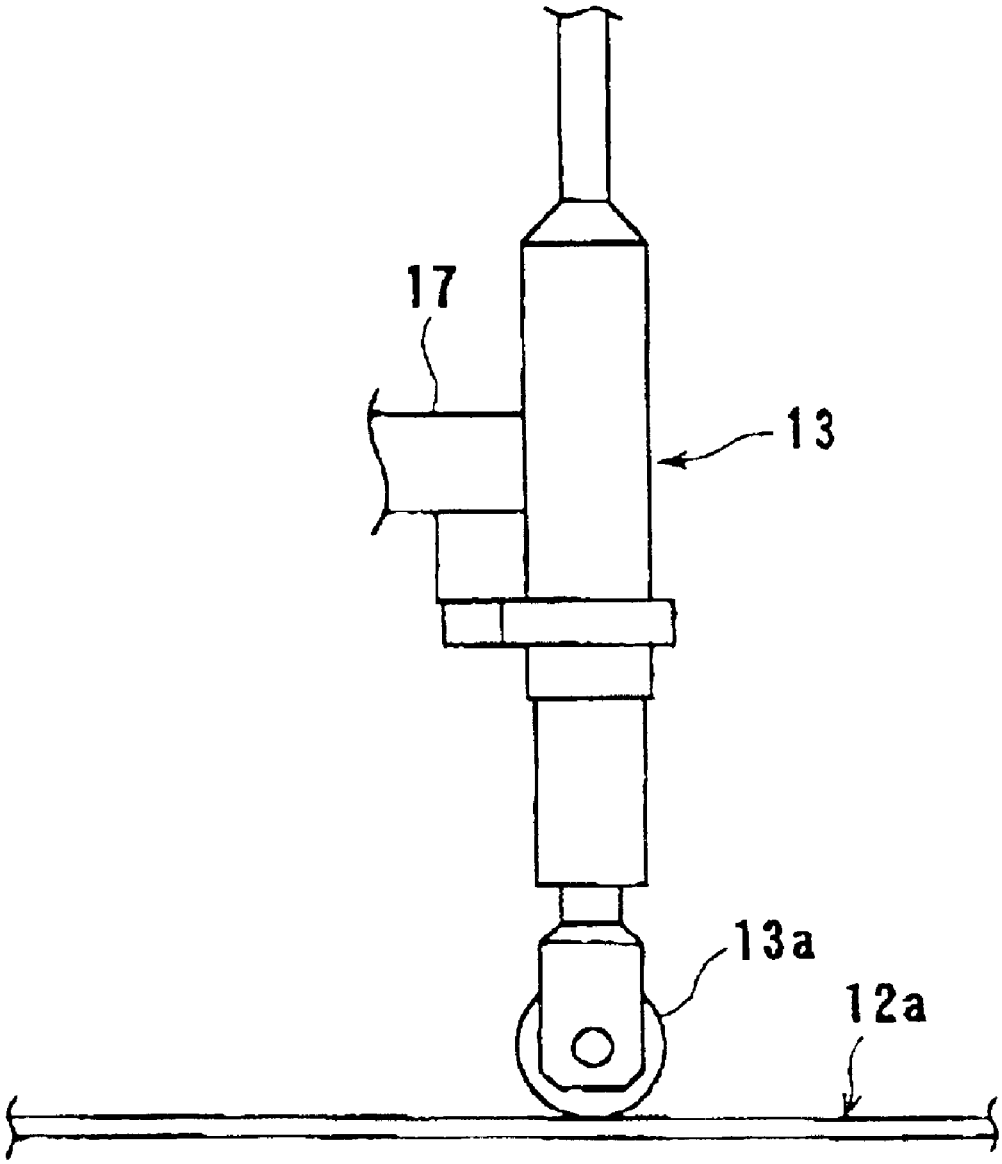
FIG. 2 is a schematic view showing a sensor used in the polishing apparatus for measuring a property of a polishing surface.

As shown in FIG. 2, the sensor 13 is a contact sensor comprising a roller 13*a* that can be held in rolling contact with the polishing surface 12*a*. While the roller 13*a* is being rolled along the polishing surface 12*a*, the roller 13*a* is vertically moved depending on irregularities or undulation of the polishing surface 12*a*. The sensor 13 has a detector (not shown) which detects the vertical movement of the roller 13*a* and converts the vertical movement into an electrical signal. Specifically, the sensor 13 is a kind of displacement sensor. The detector of the sensor 13 serves to measure the relative thickness of the polishing surface 12*a*. The roller 13*a* that can be brought into rolling contact with the polishing surface 12*a* is made of ceramics material having chemical resistance. Therefore, a substrate to be polished such as a semiconductor wafer can be prevented from being contaminated by metals or the like. The sensor 13 is mounted on the dresser head 11*a* via an attachment 17 so as to be vertically movable independently of the dresser head 11*a*.

Since the contact sensor 13 thus constructed is vertically moved in accordance with irregularities or undulations of the polishing surface 12*a*, the contact sensor 13 has a sliding contact surface between a fixed member and a movable member thereof. In the present embodiment, the sliding contact surface is covered with resin having chemical resistance. Therefore, the sensor 13 can be prevented from being contaminated by materials from external sources, and simultaneously contaminating external parts or surrounding atmosphere.

As described above, the sensor 13 measures a property of the polishing surface 12*a* while the polishing surface 12*a* is being dressed. A signal representing the measured property of the polishing surface 12 is outputted from the sensor 13 to the amplifier 16 and then amplified by the amplifier 16. The amplified signal is transmitted to the display device 21 in the measuring box 20. The display device 21 displays the property of the polishing surface 12*a*. The signal supplied to the display device 21 is inputted as measured data of the polishing surface 12*a* into the data collection system 31 in the recorder 30. The personal computer 32 accesses the measured data in the data collection system 31 and utilizes the data for reviewing conditions of the following dressing.

The dresser swing switch 14 comprises an on-off switch for swinging a dresser arm coupled to the dresser head 11*a* in such a state that the sensor 13 is placed on the polishing surface 12*a* of the turntable 12, and thereby moving the sensor 13 on and along the polishing surface 12*a*. An ON signal of the dresser swing switch 14 is transmitted to the personal computer 32 via the data collection system 31 in the recorder 30. In response to the ON signal of the dresser swing switch 14, the personal computer 32 accesses the data collection system 31 to load the measured data representing the property of the polishing surface 12*a*.

Figure 3:
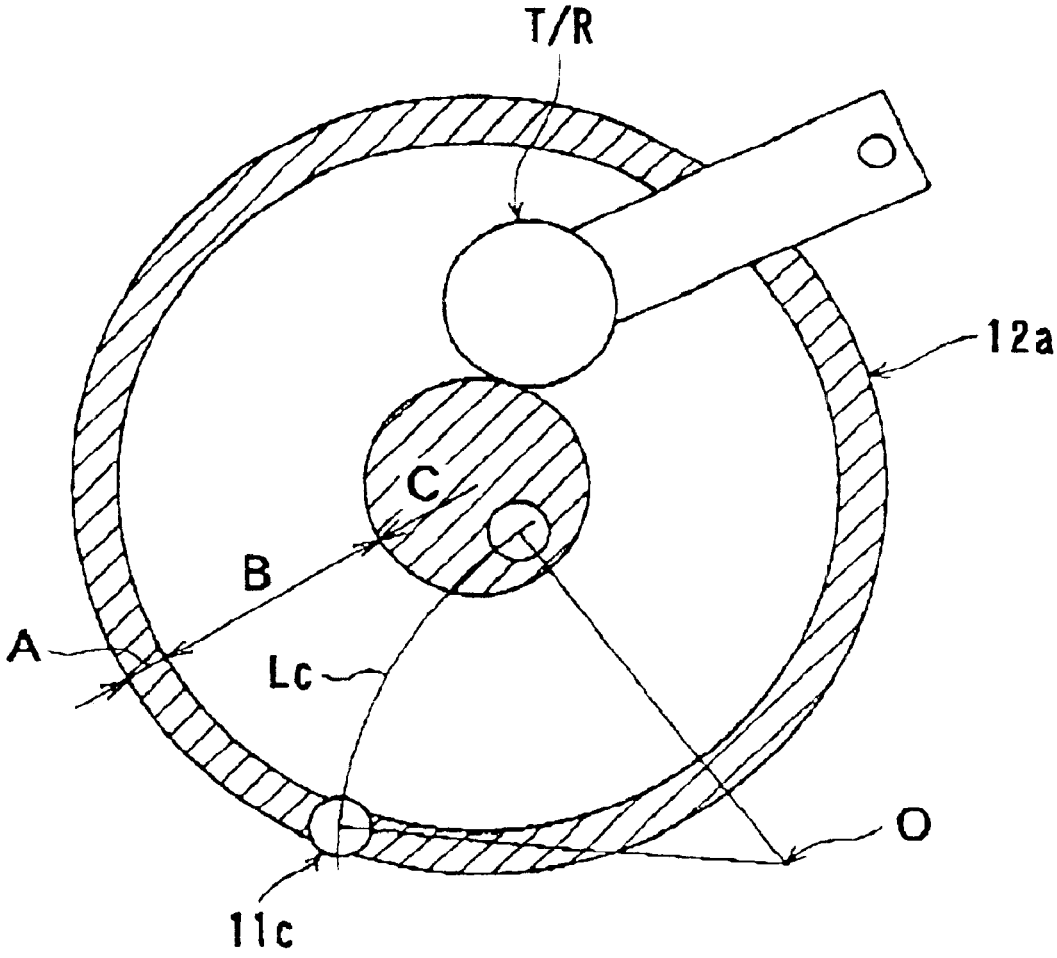
FIG. 3 is a plan view showing the relationship between the polishing surface, a top ring, and a dressing tool of the polishing apparatus.
Figure 4:
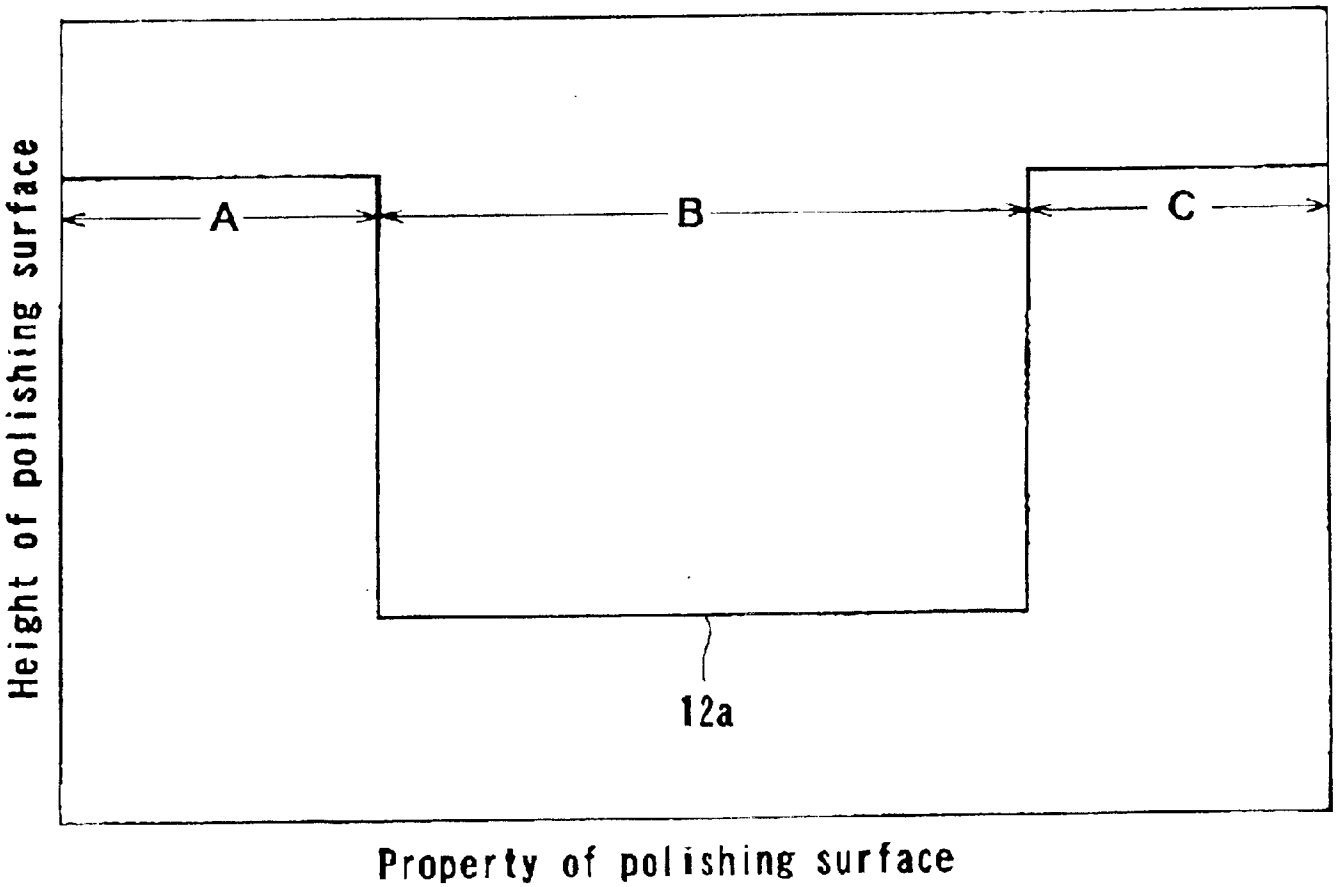
FIG. 4 is a schematic diagram showing a measured property of the polishing surface according to the polishing apparatus of the present invention.

FIG. 3 is a plan view showing the relationship between the polishing surface 12*a*, the top ring T/R, and the dressing tool 11*c*. In FIG. 3, the polishing surface 12*a* on the turntable 12 is dressed in an unhatched area B. The polishing surface 12*a* has hatched areas A and c which are not used for polishing and are not dressed. However, as shown in FIG. 4, the property of the polishing surface is monitored over a region of the polishing surface 12*a* including not only the dressing area B but also the areas A and C. This is because the polishing surface 12*a* of the areas A and C which are not actually dressed is used as a reference surface to measure the absolute amount of material of the polishing surface 12*a* that has been worn off by actual polishing and dressing.

As described above, the property of the polishing surface 12*a* can be monitored as shown in FIG. 4, while the polishing surface 12*a* is being dressed. Therefore, the two-dimensional distribution of the absolute amount of material of the polishing surface 12*a* which has been worn off can be related to polishing conditions or dressing conditions. Accordingly, the polishing conditions including top ring operation, and the dressing conditions can be optimized in a short time.

An actual process of measuring the polishing surface 12*a* will be described below. In this example, the sensor 13 is moved at a speed ranging from 10 to 200 mm/sec. The sensor 13 is mounted on the dresser head 11*a*, and the sensor 13 is moved along the polishing surface 12*a* on the turntable 12 in accordance with movement of the dresser head 11*a*. Thus, irregularities or undulations of the polishing surface 12*a* are converted into an electrical signal. The inventors have concluded form the viewpoint of experimental facilities that the speed of about 100 mm/sec of the sensor 13 is a maximum speed with allowable accuracy of the data.

The sensor 13 is moved along the polishing surface 12*a* at the above speed and measures the property of the polishing surface 12*a*. Irregularities or undulations of the polishing surface 12*a* are not measured at all points where the sensor 13 is moved. The measured signals from the sensor 13 are sampled every 4 milliseconds. For example, five sampling signals may be averaged to produce data representing a typical property of the polishing surface 12*a* in the vicinity of the sampling points. Alternatively, each of sampling signals may directly be used to represent the property of the polishing surface 12*a*.

From the viewpoint of data processing, it is convenient to measure irregularities or undulations of the polishing surface 12*a* radially across the polishing surface 12*a*. However, in the present embodiment, since the sensor 13 is mounted on the dresser head 11*a* that is angularly movable about a center O of the dresser 11 (see FIG. 3), the sensor 13 is moved along a curved line Lc around the center O, as shown in FIG. 3, rather than along a simple straight line radially across the polishing surface 12*a*.

In FIG. 3, since the dressing tool 11*c* has a diameter smaller than the width of the dressing area B, the dressing tool 11*c* is angularly moved over the range of the dressing area B for dressing the polishing surface 12*a* of the dressing area B. However, when a dresser having a diameter that is equal to the width of the dressing area B is used, it is not necessary to angularly move the dressing tool 11*c*.

The personal computer 32 serves as a determination device for determining when to replace the polishing surface 12*a*. Specifically, the personal computer 32 compares an initially measured property of the polishing surface 12*a* with a measured property thereof after the polishing surface 12*a* is dressed several times, and determines when to replace the polishing pad of the polishing surface 12*a* based on the result of comparison. Thus, the personal computer 32 determines when to replace the polishing pad based on the measured data of the polishing surface 12*a* which has been measured by the sensor 13 and collected by the data collection system 31. Accordingly, the polishing pad can be replaced with a new one at an optimum time.

The personal computer 32 may serve as a determination device for determining when to stop the dressing operation. As described above, the personal computer 32 compares the initially measured property of the polishing surface 12*a* with a measured property thereof after the polishing surface 12*a* is dressed several times. The personal computer 32 determines when to stop the dressing operation based on the result of comparison. Thus, the dressing operation can be stopped at an optimum time.

In the present embodiment, the polishing apparatus employs the polishing pad constituting a polishing surface 12*a*. The polishing pad may comprise a nonwoven fabric, or polyurethane foam, or the like. However, the principles of the present invention are also applicable to a polishing apparatus having a grinding stone or a fixed abrasive mounted on the turntable 12. The grinding stone (fixed abrasive) may comprise a disk of fine abrasive particles of, for example, $CeO_2$ having a particle size of several micrometers or less and bonded together by a binder of synthetic resin.

In the present embodiment, the sensor 13 is mounted on the dresser head 11*a* and is vertically movable independently of the dresser head 11*a*. However, for example, the sensor 13 may be mounted on the top ring head. The sensor 13 may be mounted in any desired position as long as the sensor 13 does not interfere with the dressing operation of the dresser and the polishing operation of the top ring and can measure the property of the polishing surface 12*a*.

In the present embodiments the turntable which rotates about its own axis is used as the polishing table. However, a table which makes a circulatory translational motion such as a scroll motion may be used as the polishing table.

Although certain preferred embodiments of the present invention have been shown and described in detail, it should be understood that various changes and modifications may be made therein without departing from the scope of the appended claims.

What is claimed is:

1. A polishing apparatus for polishing a workpiece, said polishing apparatus comprising:

a polishing table having a polishing surface;

a top ring for holding a workpiece and pressing the workpiece against said polishing surface;

a dresser for dressing said polishing surface, said dresser being angularly moveable; and a sensor for observing irregularity or undulation of a first area of said polishing surface that is dressed by said dresser and a second area of said polishing surface that has not been dressed by said dresser, while said polishing surface is being dressed by said dresser, said sensor being mounted on said dresser, wherein said sensor is angularly moveable together with said dresser over the first area and the second area to measure an amount of a material of the first area that has been worn off, while using the second area as a reference surface.

2. The polishing apparatus according to claim 1, further comprising a display device for displaying the property of said polishing surface observed by said sensor.

3. The polishing apparatus according to claim 2, wherein said sensor is vertically movable independently of said top ring or said dresser.

4. The polishing apparatus according to claim 1, wherein said sensor is vertically movable independently of said top ring or said dresser.

5. A polishing apparatus for polishing a workpiece, said polishing apparatus comprising:

a polishing table having a polishing surface;

a top ring for holding a workpiece and pressing the workpiece against said polishing surface;

a dresser for dressing said polishing surface; and a sensor for observing a property of a first area of said polishing surface that is dressed by said dresser and a second area of said polishing surface that has not been dressed by said dresser, while said polishing surface is being dressed by said dresser, said sensor being mounted on said dresser, wherein said sensor is angularly moveable together with said dresser over the first area and the second area to measure an amount of a material of the first area that has been worn off, while using the second area as a reference surface.

6. The polishing apparatus according to claim 5, further comprising a display device for displaying the property of said polishing surface observed by said sensor.

7. The polishing apparatus according to claim 6, wherein said sensor is vertically movable independently of said top ring or said dresser.

8. The polishing apparatus according to claim 5, wherein said sensor is vertically movable independently of said top ring or said dresser.

9. A polishing apparatus for polishing a workpiece, said polishing apparatus comprising:

a polishing table having a polishing surface;

a top ring for holding a workpiece and pressing the workpiece against said polishing surface;

a dresser for dressing said polishing surface;

a sensor for observing a property of a first area of said polishing surface that is dressed by said dresser and a second area of said polishing surface that has not been dressed by said dresser, while said polishing surface is being dressed by said dresser; and a determination device for comparing an initial property of said polishing surface which is observed by said sensor with a subsequent property of said polishing surface which is subsequently observed by said sensor, and determining when to replace a component of said polishing surface based on a result of the comparison between the initial property and the subsequent property, wherein said sensor is angularly moveable together with said dresser over the first area and the second area to measure an amount of a material of the first area that has been worn off, while using the second area as a reference surface.

10. The polishing apparatus according to claim 9, wherein said sensor is for observing irregularity or undulation of said polishing surface.

11. The polishing apparatus according to claim 9, further comprising a display device for displaying the property of said polishing surface observed by said sensor.

12. The polishing apparatus according to claim 9, wherein said sensor is vertically movable independently of said top ring or said dresser.

* * * * *